US007961096B2

(12) United States Patent
Hall

(10) Patent No.: US 7,961,096 B2
(45) Date of Patent: Jun. 14, 2011

(54) SYSTEM AND METHOD FOR DETECTION OF EAS MARKER SHIELDING

(75) Inventor: Stewart E. Hall, Wellington, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 333 days.

(21) Appl. No.: 12/352,645

(22) Filed: Jan. 13, 2009

(65) Prior Publication Data

US 2010/0176947 A1 Jul. 15, 2010

(51) Int. Cl.
*G08B 13/14* (2006.01)

(52) U.S. Cl. ..... 340/568.1; 340/568.8; 340/572.1; 340/572.3; 340/572.9; 340/10.1; 340/661; 340/551; 235/492; 235/383; 235/462.13; 348/135; 348/143

(58) Field of Classification Search ..... 340/568.1, 340/568.8, 572.1, 572.3, 572.9, 661, 551, 340/10.1; 235/492, 383, 462.13; 348/135, 348/143
See application file for complete search history.

(56) References Cited

U.S. PATENT DOCUMENTS 4,998,094 A 3/1991 Englmeier et al.
5,748,085 A * 5/1998 Davis et al. ..... 340/572.1
6,154,135 A * 11/2000 Kane et al. ..... 340/572.3
7,527,198 B2 * 5/2009 Salim et al. ..... 235/385
2005/0230604 A1 10/2005 Rowe et al.
2008/0309491 A1 12/2008 Gillard et al.

FOREIGN PATENT DOCUMENTS

EP 0736850 A1 10/1996
WO 2008028487 A1 3/2008
WO 2008125621 A1 10/2008

OTHER PUBLICATIONS

International Search Report and Written Opinion dated Jun. 4, 2010 for International Application No. PCT/US2010/000023, International Filing Date: Jan. 6, 2010 consisting of 13-pages.

* cited by examiner

*Primary Examiner* — Tai T Nguyen
(74) *Attorney, Agent, or Firm* — Christopher & Weisberg, PA

(57) ABSTRACT

A system for detecting electronic article surveillance marker shielding includes electronic article surveillance ("EAS"), metal detection and video analysis subsystems communicatively coupled to a system controller. The EAS subsystem detects EAS markers within a detection zone. The metal detection subsystem detects metallic objects within the detection zone. The video analysis subsystem captures a video image of the metallic object. The system controller determines a probable classification for the metallic object and calculates a confidence weight for the probable classification. If the metallic object is identified as EAS marker shielding according to the probable classification and the corresponding confidence weight, an alert is generated.

20 Claims, 7 Drawing Sheets

SYSTEM AND METHOD FOR DETECTION OF EAS MARKER SHIELDING

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to a method and system to detect electronic article surveillance ("EAS") marker shielding and more specifically to a method and system for detecting EAS marker shielding using a combination of metal detection, radio-frequency identification ("RFID") and video sensors to identify detected metal items and prevent false alarms.

BACKGROUND OF THE INVENTION

A growing method to defeat electronic article surveillance ("EAS") systems is the use of readily available metal foils such as aluminum foil to shield EAS markers from detection by an EAS system. Thieves often line the insides of shopping bags, handbags and backpacks with metal foil to provide a concealed compartment for placing items to be stolen while inside the store so that they can exit through the detection zone of an EAS exit systems without detection. In response to this problem, retailers are increasingly using metal detection systems tuned to detect metal foil so that they can be alerted if a foil lined bag or backpack passes through the exit.

A major problem with this approach is that there are many metal objects and products that pass through the EAS system detection zone that are not related to theft. Some examples of these items are shopping carts, wheel chairs, products that have metal or aluminized packaging, and foil bags used for keeping hot serve deli items warm, etc. The effectiveness of a metal detection system is dependent on reducing alarms from non-theft items that pass through the detection zone and increasing detection of actual foil lined bags and backpacks.

Metal detectors are typically formed with a transmitter and receiver pair. The transmitter transmits a signal and the receiver receives the transmitter signal which is attenuated and/or shifted in phase when metal is inside the interrogation zone. Traditionally, these systems discriminate between foil lined bags and other metal objects by only alarming when detecting metals that have a responsive signal with amplitudes that fall in a range that is indicative of foil lined bags rather than other items. Unfortunately, relying on amplitude is not entirely reliable because a foil lined bag that is physically close to a metal detector antenna may exhibit a responsive signal strength similar to that of a shopping cart that is located further away from the metal detector. This problem forces the metal detection systems to be confined to narrow openings and to narrowly limit the range for positive detection of foil lined bags which causes the sensitivity of the system to be degraded.

As another attempted solution, retailers sometimes place metal detection systems so that shopping carts cannot pass. In other words, the metal detectors and/or EAS systems are arranged such that shopping carts will not fit through the exits. However, controlling the flow of traffic to eliminate false alarms from shopping carts interferes with the normal behavior of customers and degrades the customer experience. Since a positive customer experience is extremely important to retailers, this approach is usually undesirable.

Retailers may also eliminate products that cause false alarms, such as metallic or metalized packaging, or foil lined bags for keeping hot serve deli items warm, etc. Eliminating products that cause false alarms also degrades the shopping experience and limits the customer choices that are extremely important to retailers. Thus, this approach is also undesirable to retailers.

Therefore, what is needed is a system and method that can identify items that are likely to be used as foil lined containers so that metal detector signals can be confirmed, as well as automatically identifying items entering a detection zone that could cause false alarms and inhibiting these false alarms.

SUMMARY OF THE INVENTION

The present invention advantageously provides a method and system for detecting electronic article surveillance marker shielding by coordinating inputs from a variety of subsystems including an electronic article surveillance subsystem, a metal detection subsystem, a video analysis subsystem and a radio-frequency identification subsystem. Correlating known conditions to predefined object classes advantageously allows more accurate shielding detection and prevents false alarms.

In accordance with one aspect of the present invention, a system for detecting electronic article surveillance marker shielding includes an electronic article surveillance subsystem, a metal detection subsystem, a video analysis subsystem and a system controller. The system controller is communicatively coupled to the electronic article surveillance subsystem, to the metal detection subsystem and to the video analysis subsystem. The electronic article surveillance subsystem detects electronic article surveillance markers within a detection zone. The metal detection subsystem includes at least one transmitting antenna and detects a metallic objects within the detection zone. The video analysis subsystem captures at least one video image of the metallic object. The system controller determines a first probable classification for the metallic object and calculates a confidence weight for the first probable classification. The system controller further identifies the metallic object as electronic article surveillance marker shielding according to the first probable classification and the corresponding confidence weight and generates an alert.

In accordance with another aspect of the present invention, a system for detecting electronic article surveillance marker shielding includes an electronic article surveillance subsystem, a metal detection subsystem, a radio-frequency identification subsystem and a system controller. The system controller is communicatively coupled to the electronic article surveillance subsystem, to the metal detection subsystem and to the radio-frequency identification subsystem. The electronic article surveillance subsystem detects electronic article surveillance markers within a detection zone. The metal detection subsystem detects metallic objects within the detection zone. The radio-frequency identification subsystem detects a radio-frequency identification tag in the detection zone, receives a tag code from the radio-frequency identification tag and determines whether the tag code is included in a listing of false alarm item codes. If the metal detection subsystem detects a metallic object within the detection zone and the radio-frequency identification subsystem determines that the tag code is not included in the listing of false alarm item codes, the system controller generates an alarm. If the metal detection subsystem detects a metallic object within the detection zone and the radio-frequency identification subsystem determines that the tag code is included in the listing of false alarm item codes, the system controller identifies the metallic object as not electronic article surveillance marker shielding.

In accordance with yet another aspect of the present invention, a method is provided for detecting electronic article surveillance marker shielding. An electronic article surveillance subsystem is provided to detect electronic article surveillance markers within a detection zone. A metallic object is detected within the detection zone and a video image of the metallic object is captured. A first probable classification for the metallic object is determined and a confidence weight for the first probable classification is calculated. The metallic object is identified as electronic article surveillance marker shielding according to the first probable classification and the corresponding confidence weight and an alert is generated.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
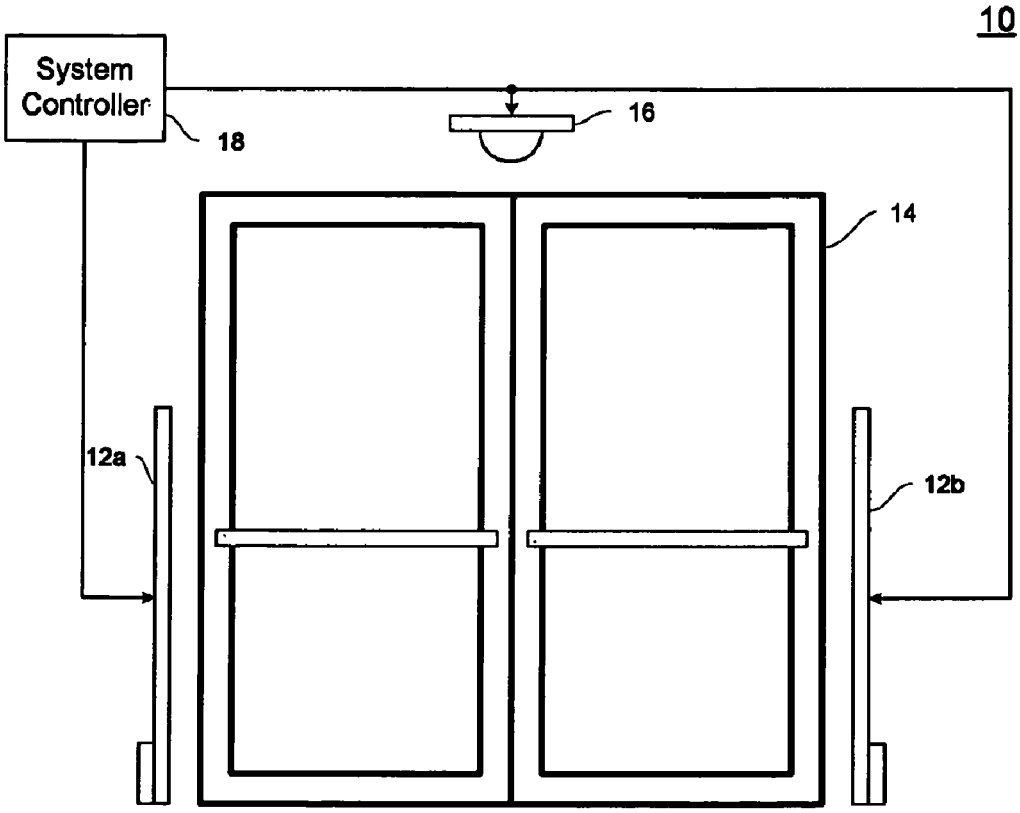
FIG. 1 is a block diagram of an exemplary Electronic Article Surveillance ("EAS") marker shield detection system constructed in accordance with the principles of the present invention.

Before describing in detail exemplary embodiments that are in accordance with the present invention, it is noted that the embodiments reside primarily in combinations of apparatus components and processing steps related to implementing a system and method for identifying items that are likely to be used as foil lined containers and identifying items entering a detection zone that could trigger false alarms in order to distinguish between real and false alarm conditions. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. Additionally, the terms "EAS marker," "EAS tag," and "EAS label" are used interchangeably herein to denote a device that is capable of being detected by an EAS detector.

One embodiment of the present invention advantageously provides a method and system to detect EAS label shielding using metal detection, RFID and video sensors. An EAS detection system designed to detect EAS markers attached to a protected item and a metal detector, which senses the presence of metal shielding materials that may be used to shield an EAS marker from detection by the EAS detection system are used in combination with one or more of an RFID reader, video sensors and a video analysis system. The RFID reader is designed to read an RFID label attached to items known to contain metal that might false alarm the metal detection system. One or more video sensors and a video analysis system determine various aspects of the environment around the other detection systems to improve the detection performance.

By using a video analysis system, the reliability of positively detecting articles in the vicinity of the detection systems which may contain EAS marker shielding, e.g., bags, backpacks, etc., is vastly improved. The video analysis system may detect the presence, location and motion of objects in the detection zone and further classify these objects to determine their type to both improve the detection of metal in the environment and identify other known metal items that may cause false alarms, e.g., metal shopping carts, wheel chairs, smaller metallic objects in close proximity to the metal detection system, etc.

Referring now to the drawing figures in which like reference designators refer to like elements, there is shown in FIG. 1 an exemplary Electronic Article Surveillance ("EAS") marker shield detection system 10 configuration located, for example, at a facility entrance. EAS marker shield detection system 10 includes a pair of pedestals 12*a*, 12*b* (collectively referenced as pedestal 12) on opposite sides of an entrance 14. Antennas for each of an EAS, RFID and metal detection subsystems may be combined in pedestals 12*a* and 12*b*, which are located a known distance apart. Video sensors 16 (one shown) may be positioned in any manner that provides a clear viewing of the entrance 14, for example, overhead. The video sensors 16 and antennas located in the pedestals 12 are communicatively coupled to a control system 18 which controls the operation of the EAS marker shield detection system 10.

Figure 2:
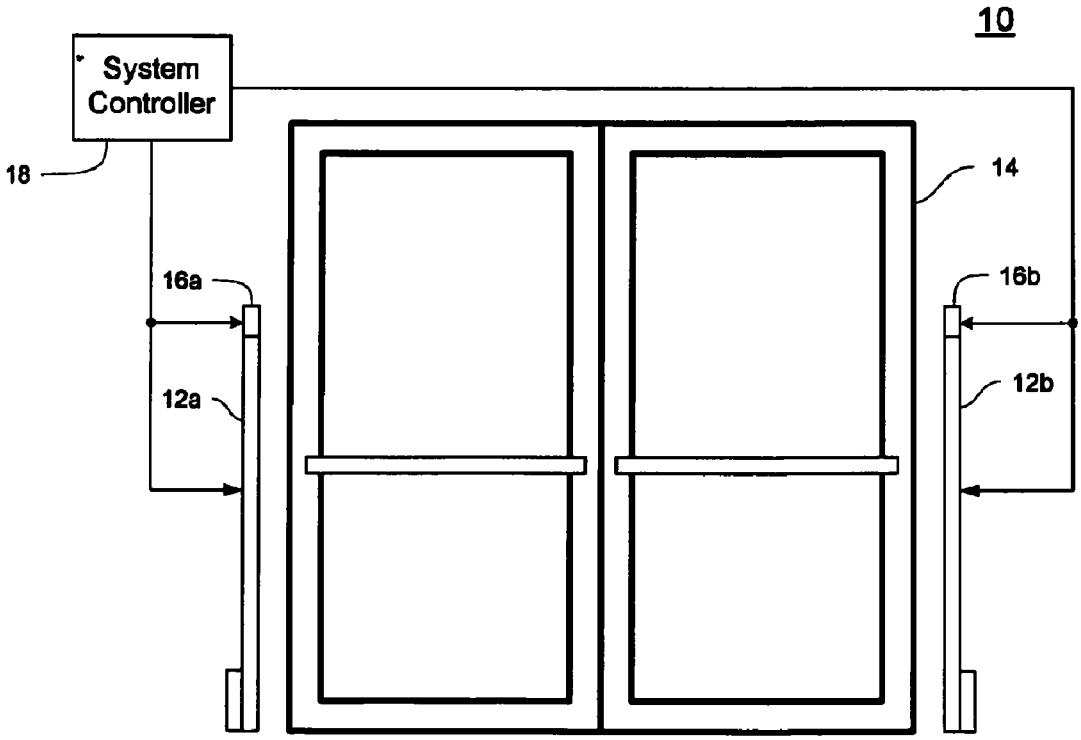
FIG. 2 is a block diagram of an alternative EAS marker shield detection system configuration constructed in accordance with the principles of the present invention.

FIG. 2 illustrates an alternative configuration of an EAS marker shield detection system 10. As in FIG. 1, the EAS, RFID and metal detection antennas are shown combined into two pedestals 12*a*, 12*b* on opposite sides of the entrance 14; however, in this configuration, the video sensors 16*a*, 16*b* (collectively referenced as video sensor 16) are also integrated into the pedestals 12. The configurations shown in FIGS. 1 and 2 are illustrative of potential configurations for the hardware and are intended to limit the scope of the present invention. There are numerous other configurations that are possible to implement the present invention.

Figure 3:
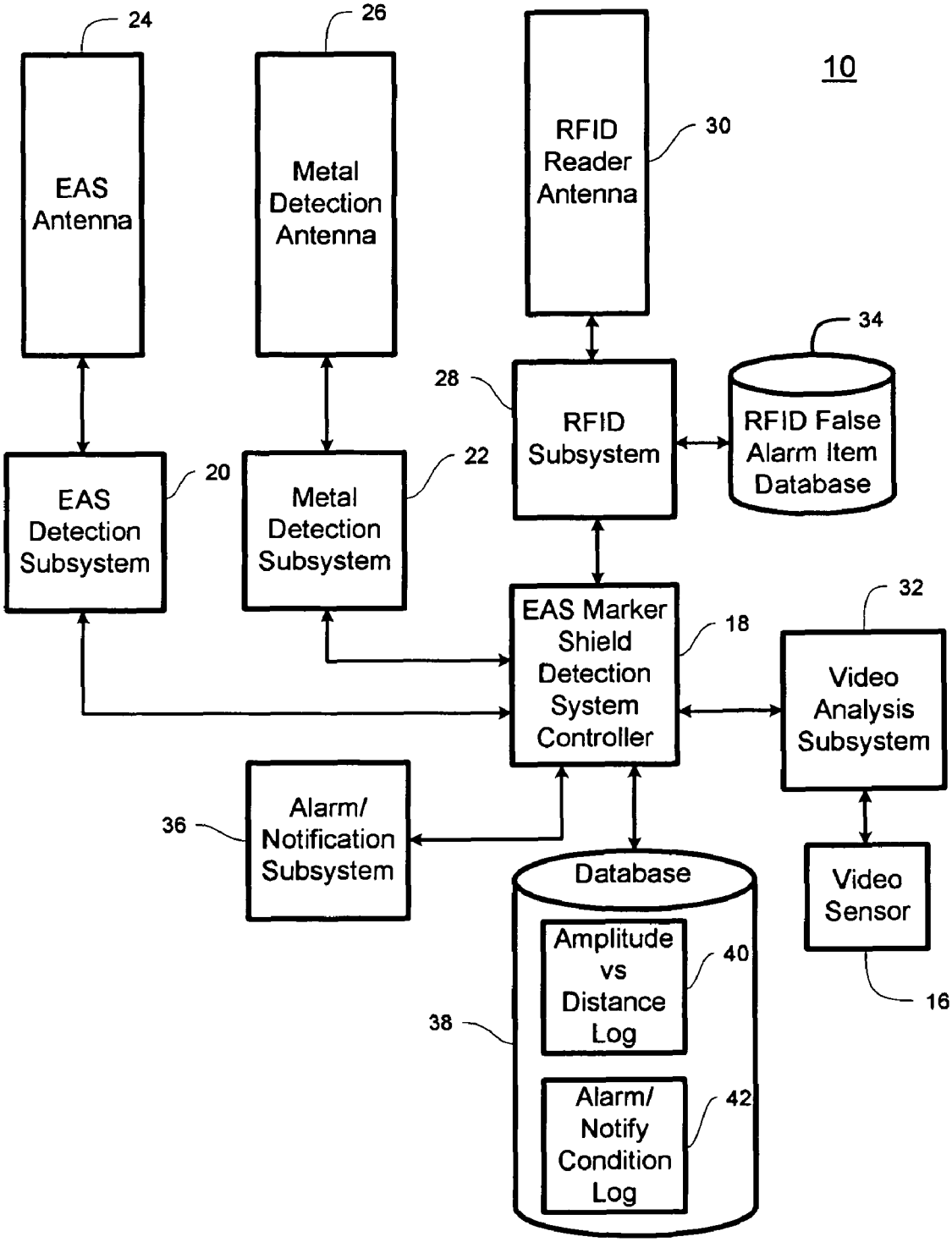
FIG. 3 is a block diagram of an exemplary control system of the EAS marker shield detection systems of FIGS. 1 and 2, constructed in accordance with the principles of the present invention.

Referring now to FIG. 3, EAS marker shield detection system 10 may include an EAS detection subsystem 20 and a metal detection subsystem 22. The EAS detection subsystem 20 detects the presence of active EAS tags on items within an interrogation or detection zone near an EAS antenna 24. Likewise, the metal detection subsystem 22 detects the presence of particular metals within a detection zone near a metal detection antenna 26. Though not explicitly shown, the metal detection antenna 26 is typically configured as a pair of antennas with a transmitting antenna located in one pedestal 12*a* and a receiving antenna located in the second pedestal 12*b*. Generally, a separate antenna or antenna pair receives signals for each subsystem, as these subsystems operate at different radio frequencies; however, it is possible that these subsystems could use the same antenna or antenna pair. In alternative embodiments, the metal detection system 22 may be deployed separately, without an integral EAS subsystem 20.

The system 10 also includes an RFID subsystem 28 coupled to an RFID antenna 30, and a video analysis subsystem 32 coupled to at least one video sensor 16. The RFID subsystem 28 collects information from active RFID tags within an interrogation or detection zone near the RFID antenna 30. The video analysis subsystem 32 collects video images from the video sensor 16 and identifies certain objects within the video images according to known video analytics techniques. In other embodiments, only one of the RFID subsystem 28 and the video analysis subsystem 32 may be deployed with the metal detection subsystem 22.

The video sensor 16 and video analysis subsystem 32 may also be used to collect other data in addition to detecting objects for use in metal detection. These uses include but are not limited to counting customer traffic through the opening, monitoring the use of shopping carts, capturing video of alarm events, etc.

Likewise, the RFID antenna 30 and the RFID subsystem 28 may be used to collect other RFID tag data in addition to that used for improving the performance of the metal detection subsystem 22. The RFID subsystem 28 is coupled to an RFID false alarm item database 34 which contains a listing of tag codes for items known to cause false alarms.

The EAS marker shield detection system 10 also includes an alarm/notification subsystem 36 which generates alarms or notifications in response to positive detection of an EAS marker shield or other defined trigger, such as detecting an active EAS tag within the interrogation zone.

Each subsystem, i.e., the EAS detection subsystem 20, the metal detection subsystem 22, the RFID subsystem 28, the video analysis subsystem 32, and the alarm/notification subsystem 36, is coupled to the EAS marker shield detection system controller 18 which controls the overall operation of the EAS marker shield detection system 10. The EAS marker shield detection system controller 18 is further coupled to a system database 38 which may contain a variety of logs, such as an object amplitude vs. distance log 40 and an alarm/notify condition log 42. The object amplitude vs. distance log 40 details the signal amplitude received from metal detection subsystem 22 as a function of distance from the metal detection antenna 24 for a variety of metals. The alarm/notify condition log 42 includes instructions for responses to different alarm conditions. It should be noted that although the RFID false alarm item database 34 is depicted as a separate entity from the system database 38, both databases may be physically located as a single device.

Figure 4:
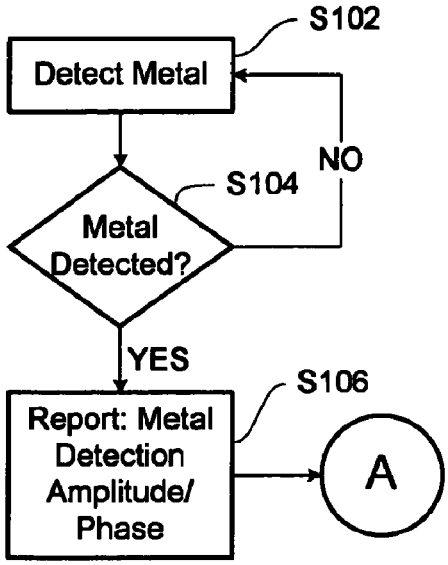
FIG. 4 is a flowchart of an exemplary metal detection process performed by a metal detection subsystem of an EAS marker shield detection system according to the principles of the present invention.
Figure 6:
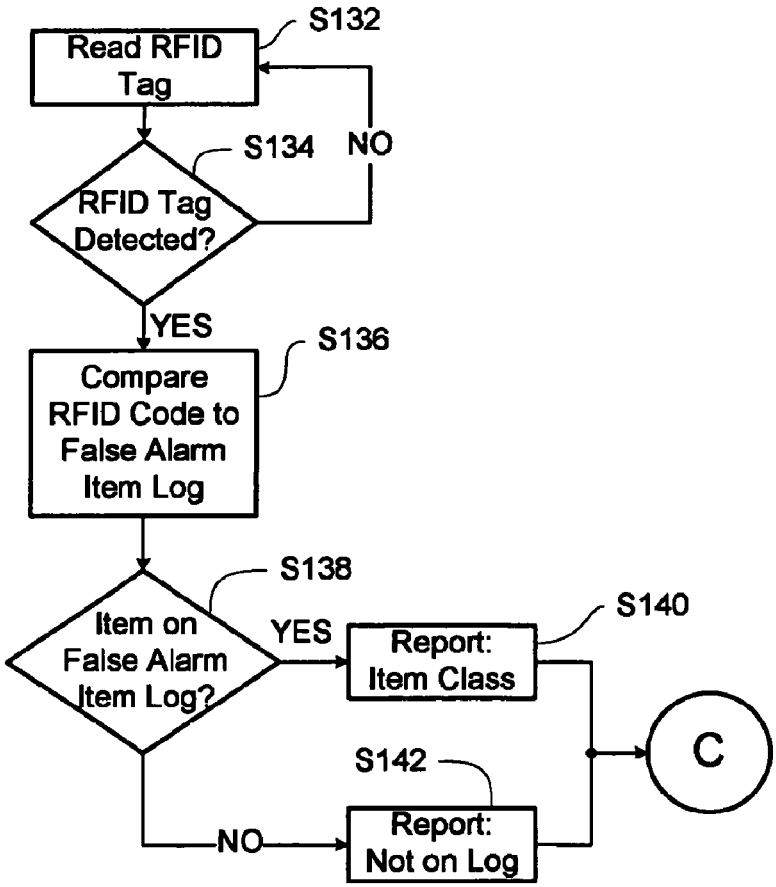
FIG. 6 is a flowchart of an exemplary Radio Frequency Identification ("RFID") detection process performed by a RFID detection subsystem of an EAS marker shield detection system according to the principles of the present invention.
Figure 5:
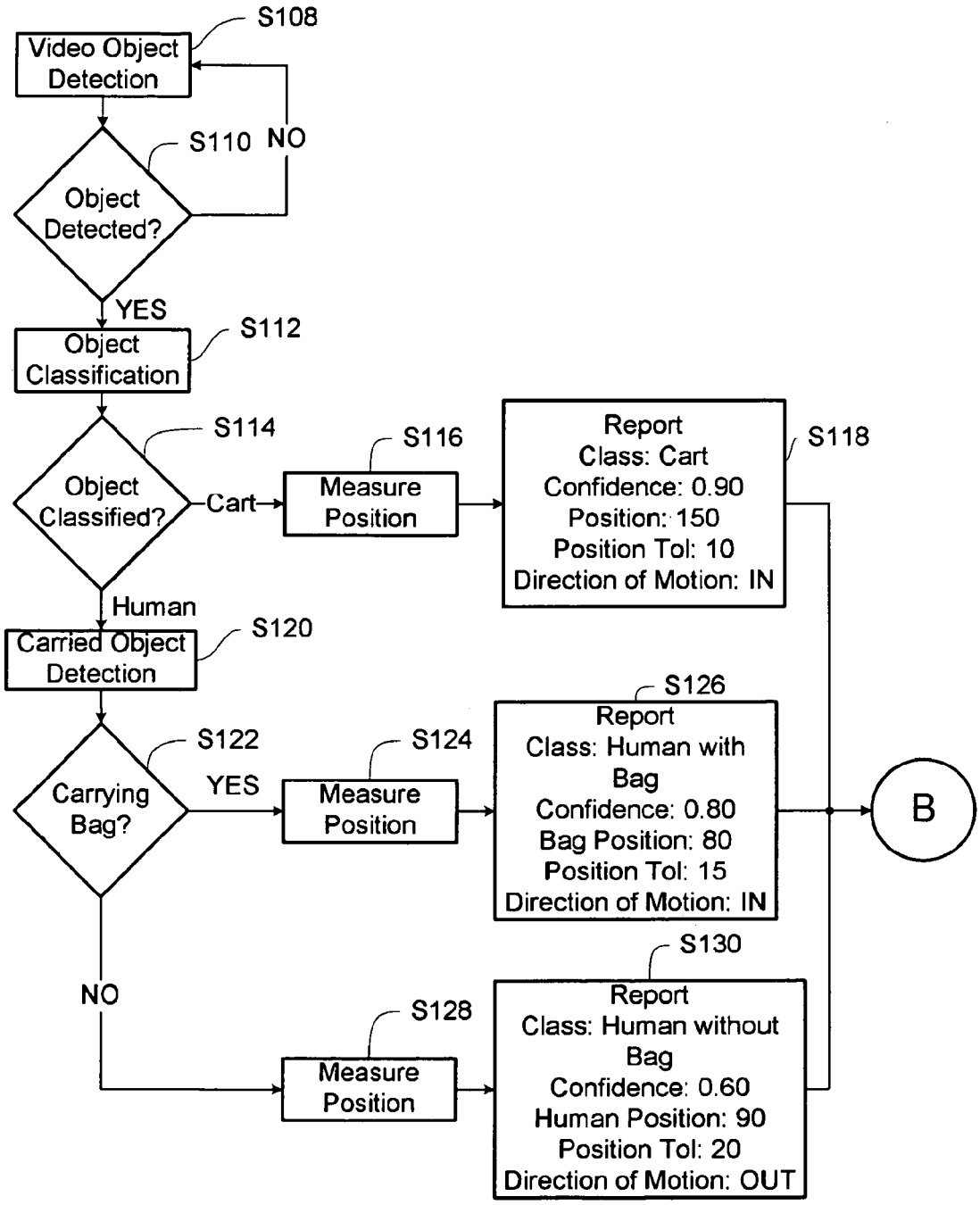
FIG. 5 is a flowchart of an exemplary video analysis process performed by a video detection subsystem of an EAS marker shield detection system according to the principles of the present invention.
Figure 7:
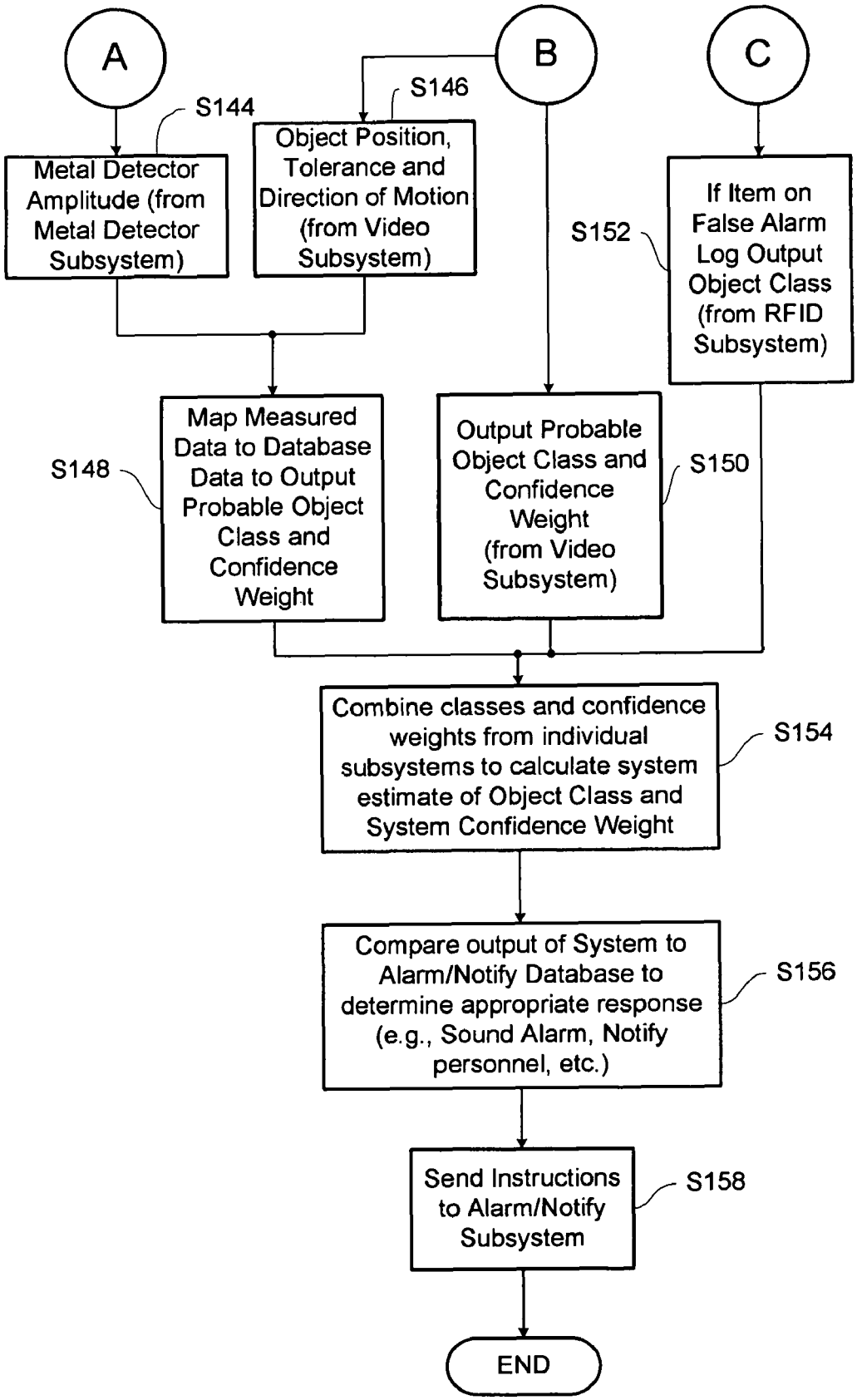
FIG. 7 is a flowchart of an exemplary top level operation process performed by an EAS marker shield detection system according to the principles of the present invention.

Referring now to FIGS. 4-6, exemplary operational flowcharts are provided that describe the operation of the various subsystems. FIG. 7 describes the top level operation of the EAS marker shield detection system 10. In FIG. 4, a simplified exemplary operational flowchart describes steps performed by the metal detection subsystem 22. The metal detection subsystem 22 normally operates in a metal detection phase (step S102) until metal is detected in the detection zone (step S104). When metal is detected, the metal detection subsystem 22 reports this information, including the amplitude and phase of the detected signal, to the EAS marker shield detection system controller 18 for further processing (step S106). In alternate configurations the system may use only amplitude or only phase.

In FIG. 5, an exemplary operational flowchart describes steps performed by the video analysis subsystem 32. The video analysis subsystem 32 normally operates in a video collection phase (step S108) until an object is detected in the detection zone (step S110). When an object has been detected, the video analysis subsystem 32 attempts to classify the object into a known class (step S112). In this exemplary case, the video analysis subsystem 32 is designed to classify objects into three classes: shopping carts, humans with bags and humans without bags. In alternate configurations, detected objects may be classified into other classes, such as but not limited to, wheelchairs, strollers, other carried items, etc. Object classification may be accomplished by numerous pattern classification algorithms known by those skilled in the art such as template matching, principal component analysis, etc.

The outputs of the classification step (step S112) may include the probable class of the object and the confidence weight from the classification. For illustration, a high confidence number, e.g., close to 1, represents a very high probability that the classification result from the algorithm is correct. A low confidence number, e.g., close to 0, represents a very low probability that the classification result is correct.

In addition to object classification, the video analysis subsystem provides as an output a measurement of the location of the object and a measurement tolerance. Thus, if the object is classified as a cart (step S114), the relative position of the cart is measured (step S116) and the relevant information is reported to the EAS marker shield detection system controller 18 for further processing (step S118). For illustration, the position number 150 may represent that object is 150 cm from a reference point at the transmitter pedestal. A tolerance of 10 may represent that the video analysis subsystem estimates the uncertainty of the position number as +/−10 cm.

Returning to decision block S114, if the video analysis subsystem 32 determines that the object is a human, a carried object detection process is performed (step S120) to determine whether the person is carrying a bag. If the person is carrying bag (step S122), the position of the bag is measured (step S124) and the relevant information, e.g., class, confidence level, bag position, bag position tolerance and direction of motion (whether the object is going into or coming out of the facility), is reported to the EAS marker shield detection system controller 18 for further processing (step S126). If the person is not carrying a bag (step S122), the position of the actual person is measured (step S128) and the relevant information, e.g., class, confidence level, position and position tolerance and direction of motion, is reported to the EAS marker shield detection system controller 18 for further processing (step S130).

Referring to FIG. 6, an exemplary simplified flowchart of the RFID subsystem 28 operation is provided. Retailers may place RFID tags on items known to cause false alarms, thereby enhancing the operation of the EAS marker shield detection system 10. The RFID subsystem 28 normally operates in an RFID tag detection phase (step S132) until an RFID tag is detected in the detection zone (step S134). When an RFID tag is detected, the RFID subsystem 28 reads the RFID tag, it compares the tag code to a log of false alarm items in an RFID false alarm item database 34 (step S136). Typical types of items on the false alarm log include both store equipment, such as shopping carts, and products that are known to alarm the metal detection system. Examples of products from the supermarket include barbequed chicken kept warm in a foil bag, cases of powdered baby formula, etc. If a detected tag is in the RFID false alarm item database 34 (step S138), the RFID subsystem 28 reports the item and its class to the EAS marker shield detection system controller 18 for further processing (step S140). If a detected tag is not on the RFID false alarm item database 34 (step S138), the RFID subsystem 28 reports the item and the determination that the item is not in the RFID false alarm item database 34 to the EAS marker shield detection system controller 18 for further processing (step S142).

Referring now to FIG. 7, an exemplary operational flowchart of the top level operation of the EAS marker shield detection system 10 is provided. Inputs from the metal detection subsystem 22 (connector A in FIG. 4), the video analysis subsystem 32 (connector B in FIG. 5) and the RFID subsystem 28 (connector C in FIG. 6) are combined and analyzed to provide improved metal detection performance. In this embodiment, the metal detector amplitude (step S144) from the metal detector subsystem 22 and the object position, tolerance and direction of motion data (step S146) are mapped and compared to an object amplitude vs. distance database (step S148) to output a probable object class and confidence weight. The object class and confidence weights from the video analysis subsystem 32 (step S150) and the inputs from the RFID subsystem 28 (step S152) are combined with the probable object class and confidence weight resulting from comparing the metal detection subsystem 22 signal amplitude to calculate a combined system estimate for the object class and confidence (step S154). Many different methods known by those skilled in the art may be used to calculate this combined object class and confidence estimate, including but not limited to, linear systems approaches, neural network approaches and fuzzy logic approaches. For example, a simple linear system may be employed to map a result which then may be compared to a simple fixed threshold for individual classes of objects stored in an alarm/notify condition log 42 (step S156). A linear system mapping and fixed threshold database is used for illustrative purposes only, but other more adaptive approaches from machine learning known to those skilled in the art may be employed to deploy an adaptive system that is able to learn from the environment and adapt to changes in the retail environment.

The EAS marker shield detection system controller 18 sends instructions to the alarm/notify subsystem 36 based on the corresponding action found in the alarm/notify condition log 42. For example, the alarm/notify subsystem 36 may enable an audible or visual alert, alert or email security or other personnel, call law enforcement authorities, etc. In certain situations, the alarm/notify subsystem 36 may only alarm when an object is moving into the store from the outside. This criterion would help to detect people bringing foil lined bags into the store so that security personnel may be notified to observe that customer and to collect evidence of shoplifting.

Figure 8:
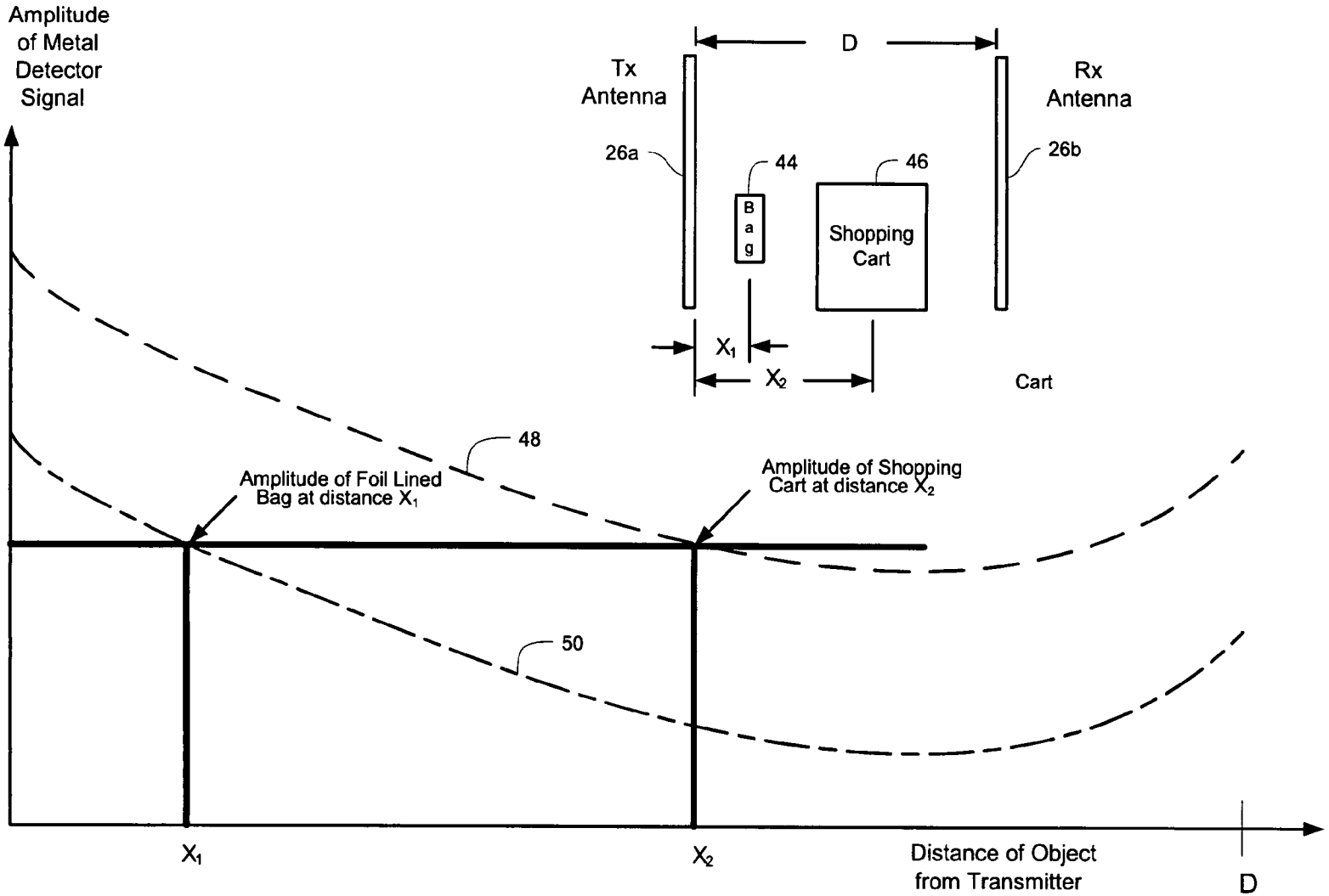
FIG. 8 is a graph illustrating exemplary comparative amplitudes of a shopping cart and a foil lined bag as a function of distance from a metal detector transmitter antenna.

Referring now to FIG. 8, a graph is provided that illustrates the amplitude of two metal objects in the metal detection subsystem 22 as a function of the distance from the metal detection transmit antenna 26*a*. Object 44 is a foil lined bag located at distance $X_1$ from the transmitter antenna 26*a* ($T_x$). Object 46 is a metal shopping cart located at distance $X_2$ from the $T_x$ antenna 26*a*. Also shown in FIG. 8 is a set of curves 48, 50 showing the relationship between the amplitude of the output of the metal detection circuit as a function of distance of the object from the $T_x$ antenna 26*a*. The top curve 48 shows the typical amplitude as a function of distance for a shopping cart, which is a large metallic object. The lower curve 50 shows the typical amplitude as a function of distance for a foil lined bag, which is a much smaller metallic object than a shopping cart. The graph shows that the metal detection circuit alone cannot tell the difference between the foil lined bag at distance $X_1$ from the $T_x$ antenna 26*a* from the shopping cart at distance $X_2$ from the $T_x$ antenna 26*a* because the response signals from both items exhibit the same amplitude.

Figure 9:
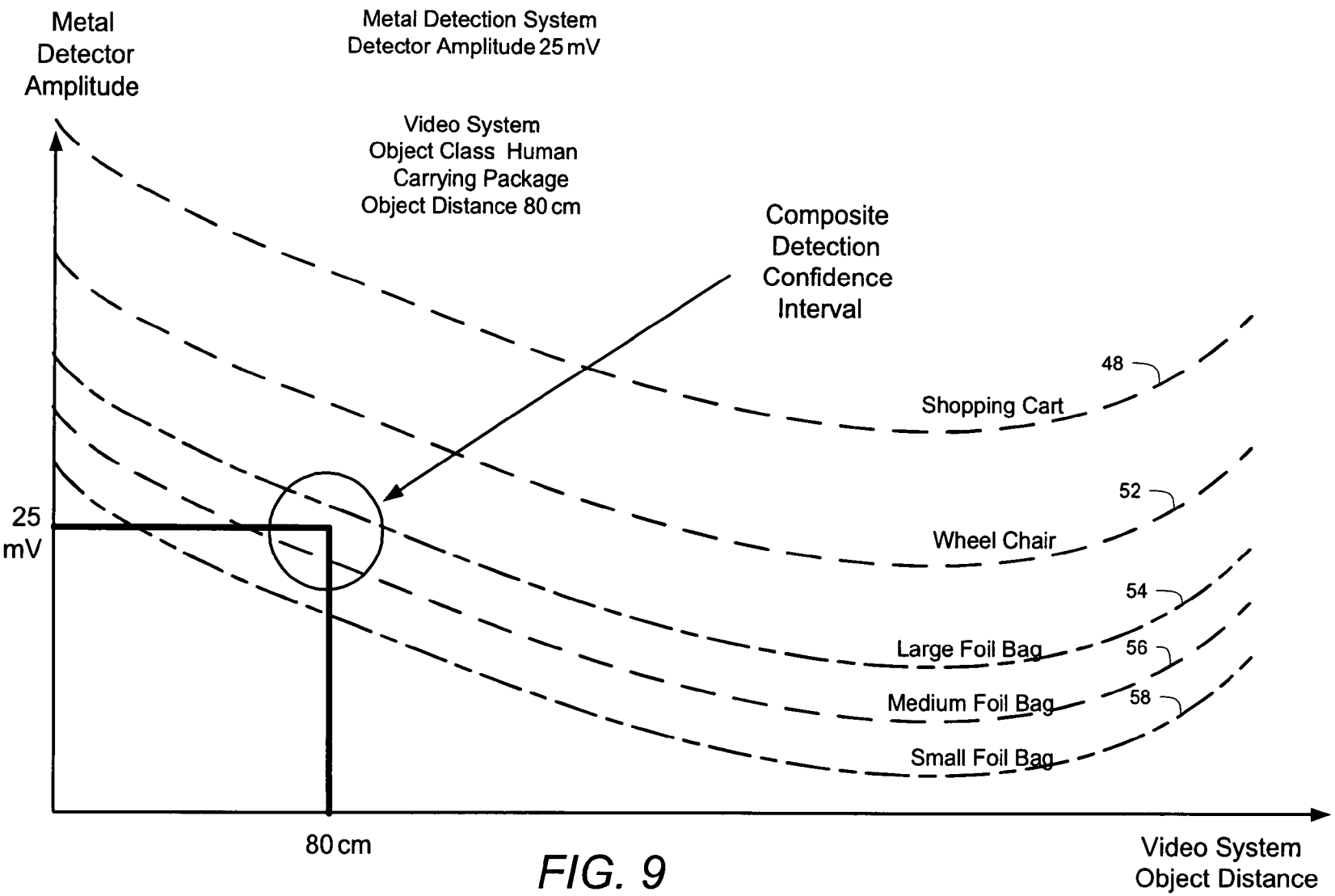
FIG. 9 is a graph illustrating exemplary relationships between metal detector output amplitude and distance of an object from a metal detector transmitter antenna for several classes of metallic objects.

In an illustration of how the present invention improves detection discrimination between items is shown in FIG. 9. The relationship between metal detector output amplitude and distance of the object from the antenna is shown for several different classes of metallic objects. Curve 48 is a typical response curve for a shopping cart, curve 52 represents a wheelchair, curve 54 represents a large foil-lined bag, curve 56 represents a medium foil-lined bag and curve 58 represents a small foil-lined bag. Since the video analysis subsystem 32 provides an estimate of the distance of the target object from the $T_x$ antenna 26*a*, and the metal detection subsystem 22 of the invention provides the amplitude of the detection circuit's response, these two outputs may be combined with other information to make a better decision about the class of metallic object that is detected in the system 10. By better classifying the object according to this additional information a better decision may be discerned. For example, in FIG. 9, the amplitude and estimated distance are combined to generate an estimate of the class of the object and a confidence weight that estimates the degree of confidence that the classification estimate is correct.

Referring once more to FIG. 7, the output of each of these individual subsystems, i.e., the EAS detection subsystem 20, the metal detection subsystem 22, the RFID subsystem 28, the video analysis subsystem 32, and the alarm/notification subsystem 36, along with the confidence weights from each of the subsystems is combined to make an overall decision to alarm or notify that a foil lined bag is present in the detection zone. The method for making this decision may be accomplished by many different methods including linear techniques or neural networking methods. The method shown in FIG. 7 implements a simple weighted summation of each of the subsystem outputs and compares the weighted sum with a stored threshold. Many other appropriate methods know by those skilled in the art from pattern recognition and machine learning may also be used to determine the best result. In addition, adaptive learning techniques may be employed to allow the system to adapt to the conditions within the installation environment.

The present invention can be realized in hardware, software, or a combination of hardware and software. Any kind of computing system, or other apparatus adapted for carrying out the methods described herein, is suited to perform the functions described herein.

A typical combination of hardware and software could be a specialized or general purpose computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A system for detecting electronic article surveillance marker shielding, the system comprising:

an electronic article surveillance subsystem operable to detect electronic article surveillance markers within a detection zone;

a metal detection subsystem including at least one transmitting antenna, the metal detection subsystem operable to detect a metallic object within the detection zone;

a video analysis subsystem operable to capture at least one video image of the metallic object; and a system controller communicatively coupled to the electronic article surveillance subsystem, the metal detection subsystem and the video analysis subsystem, the system controller operable to:

determine a first probable classification for the metallic object;

calculate a confidence weight for the first probable classification;

identify the metallic object as electronic article surveillance marker shielding according to the first probable classification and the corresponding confidence weight; and generate an alert.

2. The system of claim 1, wherein the video analysis subsystem is further operable to determine a direction of motion of the metallic object, the system controller only generating an alert responsive to the video analysis subsystem determining that the direction of motion is heading into a monitored facility.

3. The system of claim 1, wherein:

the metal detection subsystem further determines an amplitude of a response signal;

the video analysis subsystem further measures a distance between the metallic object and the transmitting antenna; and the system controller determines the first probable classification for the metallic object by correlating the amplitude of the response signal and the distance between the metallic object and the transmitting antenna to data corresponding to predefined object classes.

4. The system of claim 3, wherein the predefined object classes include at least two of: a cart, a human carrying a bag, a human not carrying a bag, a wheelchair, a stroller and a carried object.

5. The system of claim 3, wherein the video analysis subsystem is further operable to:

provide a tolerance value for the distance measurement; and use the tolerance value to calculate the confidence weight for the first probable classification.

6. The system of claim 1, wherein generating an alert comprises at least one of sounding an audible alert, enabling a visual alert, and transmitting an alert notification.

7. The system of claim 1, further comprising:

a radio-frequency identification subsystem communicatively coupled to the system controller, the radio-frequency identification subsystem operable to:

detect a radio-frequency identification tag in the detection zone;

receive a tag code from the radio-frequency identification tag;

compare the tag code to a listing of false alarm item codes; and responsive to determining the tag code is included in the listing of false alarm item codes, identify the metallic object as not electronic article surveillance marker shielding.

8. The system of claim 1, wherein the video analysis subsystem is further operable to:

determine a second probable classification of the object according to the predefined object classes using video object recognition techniques; and calculate a confidence weight for the second probable classification.

9. The system of claim 8, wherein the system controller is further operable to:

combine the first probable object classification and the corresponding confidence weight with the second probable object classification and the corresponding confidence weight to calculate a system object classification and corresponding system confidence weight; and identify the metallic object according to the system probable classification and the corresponding system confidence weight.

10. The system of claim 9, further comprising:

a radio-frequency identification subsystem communicatively coupled to the system controller, the radio-frequency identification subsystem operable to:

detect a radio-frequency identification tag in the detection zone;

receive a tag code from the radio-frequency identification tag;

compare the tag code to a listing of false alarm item codes; and responsive to determining the tag code is included in the listing of false alarm item codes, identify the metallic object as not electronic article surveillance marker shielding.

11. A system for detecting electronic article surveillance marker shielding, the system comprising:

an electronic article surveillance subsystem operable to detect electronic article surveillance markers within a detection zone;

a metal detection subsystem operable to detect metallic objects within the detection zone;

a radio-frequency identification subsystem operable to:

detect a radio-frequency identification tag in the detection zone;

receive a tag code from the radio-frequency identification tag; and determine whether the tag code is included in a listing of false alarm item codes, a system controller communicatively coupled to the electronic article surveillance subsystem, to the metal detection subsystem and to the radio-frequency identification subsystem, the system controller is operable to:

responsive to the metal detection subsystem detecting a metallic object within the detection zone and the radio-frequency identification subsystem determining that the tag code is not included in the listing of false alarm item codes, generate an alarm; and responsive to the metal detection subsystem detecting a metallic object within the detection zone and the radio-frequency identification subsystem determining that the tag code is included in the listing of false alarm item codes, identify the metallic object as not electronic article surveillance marker shielding.

12. The system of claim 11, wherein generating an alert comprises at least one of sounding an audible alert, enabling a visual alert, and transmitting an alert notification.

13. A method for detecting electronic article surveillance marker shielding, the method comprising:

providing an electronic article surveillance subsystem to detect electronic article surveillance markers within a detection zone;

detecting a metallic object within the detection zone;

capturing a video image of the metallic object;

determining a first probable classification for the metallic object;

calculating a confidence weight for the first probable classification;

identifying the metallic object as electronic article surveillance marker shielding according to the first probable classification and the corresponding confidence weight; and generating an alert.

14. The method of claim 13, further comprising:

transmitting a metal detecting signal;

determining an amplitude of a response signal to the metal detecting signal;

measuring a distance between the metallic object and a transmitting antenna; and determining the first probable classification for the metallic object by correlating the amplitude of the response signal and the distance between the metallic object and the transmitting antenna to data corresponding to predefined object classes.

15. The method of claim 14, wherein the predefined object classes include at least two of: a cart, a human carrying a bag, a human not carrying a bag, a wheelchair, a stroller and a carried object.

16. The method of claim 14, further comprising:

providing a tolerance value for the distance measurement; and using the tolerance value to calculate the confidence weight for the first probable classification.

17. The method of claim 13, wherein generating an alert comprises at least one of sounding an audible alert, enabling a visual alert, and transmitting an alert notification.

18. The method of claim 13, further comprising:

detecting a radio-frequency identification tag in the detection zone;

receiving a tag code from the radio-frequency identification tag;

comparing the tag code to a listing of false alarm item codes; and responsive to determining the tag code is included in the listing of false alarm item codes, identifying the object as not electronic article surveillance marker shielding.

19. The method of claim 13, further comprising:

determining a second probable classification of the object according to the predefined object classes using video object recognition techniques;

calculating a confidence weight for the second probable classification;

combining the first probable object classification and the corresponding confidence weight with the second probable object classification and the corresponding confidence weight to calculate a system object classification and corresponding system confidence weight; and identifying the metallic object according to the system probable classification and the corresponding system confidence weight.

20. The method of claim 19, further comprising:

detecting a radio-frequency identification tag in the detection zone;

receiving a tag code from the radio-frequency identification tag;

comparing the tag code to a listing of false alarm item codes; and responsive to determining the tag code is included in the listing of false alarm item codes, identifying the metallic object as not electronic article surveillance marker shielding.

* * * * *